US009603401B2

(12) United States Patent
Pruitt et al.

(10) Patent No.: US 9,603,401 B2
(45) Date of Patent: Mar. 28, 2017

(54) SYSTEMS AND APPARATUS OF MAGNETIC CLASPING

(71) Applicant: bSwitched Jewelry LLC, Dacula, GA (US)

(72) Inventors: Terrell A. Pruitt, Lawrenceville, GA (US); Bobbi Jo Shingleton, Dacula, GA (US)

( * ) Notice: Subject to any disclaimer, the term of this patent is extended or adjusted under 35 U.S.C. 154(b) by 186 days.

(21) Appl. No.: 14/027,122

(22) Filed: Sep. 13, 2013

(65) Prior Publication Data

US 2015/0074954 A1 Mar. 19, 2015

(51) Int. Cl.

| | |
|---|---|
| ***A44C 5/20*** | (2006.01) |
| ***A41F 1/00*** | (2006.01) |
| ***A44B 99/00*** | (2010.01) |

(52) U.S. Cl.

CPC ..... *A41F 1/002* (2013.01); *A44B 99/00* (2013.01); *A44C 5/2071* (2013.01); *A44D 2203/00* (2013.01); *Y10T 24/32* (2015.01)

(58) Field of Classification Search

CPC ..... A44C 5/185; A44C 5/18; A44C 5/2076; A44C 5/2071; A44C 5/2085; A44C 5/20; A44C 13/00; A44C 25/00; H01F 7/0263; A41F 1/002; A44B 99/00; A44B 11/25; A44B 11/2534; A44B 11/2592; A44B 11/2596; Y10T 24/32; A44D 2203/00; F16B 1001/0035; A45C 13/1069

USPC ... 24/265 EC, 265 AL, 574.1, 265 R, 136 K, 24/136 R; 63/3.1, 900

See application file for complete search history.

(56) References Cited

U.S. PATENT DOCUMENTS

| | | | | |
|---|---|---|---|---|
| 2,615,227 | A * | 10/1952 | Hornik | A44C 5/2071 24/303 |
| 3,063,118 | A | 11/1962 | Salter et al. | |
| 3,111,736 | A | 11/1963 | Budreck | |
| 3,129,477 | A | 4/1964 | Mizuno | |
| 3,324,521 | A | 6/1967 | Humiston | |
| 3,341,906 | A | 9/1967 | Williams | |
| 3,481,155 | A | 12/1969 | Cook | |
| 4,231,137 | A | 11/1980 | Fujimoto | |
| 4,783,974 | A | 11/1988 | Hernandez | |
| D305,412 | S | 1/1990 | Zemer | |
| 4,901,405 | A | 2/1990 | Grover et al. | |
| 4,912,944 | A | 4/1990 | Crosley et al. | |
| 4,982,581 | A | 1/1991 | Furuyama | |
| 5,007,252 | A | 4/1991 | Mochizuki | |
| 5,008,984 | A | 4/1991 | Levy | |
| 5,048,310 | A | 9/1991 | Riley | |
| 5,092,019 | A | 3/1992 | Levy | |
| 5,097,679 | A | 3/1992 | Johnson et al. | |
| 5,157,945 | A * | 10/1992 | Giehl | 63/33 |
| 5,195,335 | A | 3/1993 | Hart | |

(Continued)

*Primary Examiner* — Jack W Lavinder

(74) *Attorney, Agent, or Firm* — Benjamin A. Balser; Next ip Law Group LLC

(57) ABSTRACT

Example embodiments of the systems and methods of magnetic clasping disclosed herein include a a self-aligning interlocking magnetic clasp. When the two halves are placed within close proximity of each other, the magnetic attraction of the magnets within the clasps orient the parts, and the mechanical features of a key, a keyway and a sliding face align. These features hold the two clasps together with the opposed sliding faces coincident and the keys and keyways interlocked, forming a bead shape, for example, with a hole through the middle.

18 Claims, 6 Drawing Sheets

(56) References Cited

U.S. PATENT DOCUMENTS

| | | | | |
|---|---|---|---|---|
| 5,197,168 | A | 3/1993 | Levy | |
| 5,311,647 | A | 5/1994 | Levy | |
| 5,349,725 | A | 9/1994 | Levy | |
| 5,367,891 | A | 11/1994 | Furuyama | |
| 5,477,714 | A | 12/1995 | Bishop | |
| 5,572,887 | A | 11/1996 | Geswelli | |
| 5,664,298 | A | 9/1997 | Nessar-Ivanovic | |
| 5,794,459 | A | 8/1998 | Ignatowski | |
| 5,806,346 | A | 9/1998 | Schlinger et al. | |
| 5,845,373 | A | 12/1998 | Langer | |
| 5,887,448 | A | 3/1999 | Gilbert et al. | |
| 6,292,985 | B1 | 9/2001 | Grunberger | |
| 6,381,985 | B1 | 5/2002 | Burgard | |
| 6,394,677 | B2 * | 5/2002 | Wang | 401/6 |
| 6,539,749 | B2 | 4/2003 | Gibbs, III | |
| 6,561,206 | B1 | 5/2003 | Wilkinson | |
| 6,591,462 | B2 | 7/2003 | Fuhrman | |
| 6,594,871 | B2 | 7/2003 | Hoffman | |
| 6,595,025 | B2 | 7/2003 | Lau | |
| 6,640,398 | B2 | 11/2003 | Hoffman | |
| 6,701,583 | B1 | 3/2004 | McCullough | |
| 6,715,315 | B1 | 4/2004 | Hartgrove | |
| 6,718,797 | B2 | 4/2004 | Plumly | |
| 6,729,159 | B2 | 5/2004 | Rose | |
| 6,851,279 | B2 | 2/2005 | Hartgrove | |
| 6,962,063 | B1 | 11/2005 | Pearl | |
| 6,981,391 | B2 | 1/2006 | Suzuki | |
| 7,073,232 | B1 | 7/2006 | Fuhrman et al. | |
| 7,143,607 | B2 | 12/2006 | Hartgrove | |
| 7,201,021 | B2 | 4/2007 | Hartgrove | |
| 7,334,433 | B1 | 2/2008 | Fuhrman et al. | |
| 7,523,527 | B2 | 4/2009 | Garber | |
| 7,654,112 | B2 | 2/2010 | Pons | |
| 7,690,088 | B2 | 4/2010 | Kogen | |
| 7,726,152 | B2 | 6/2010 | Beard | |
| 7,735,336 | B2 | 6/2010 | Williams | |
| 7,827,622 | B2 | 11/2010 | Claro | |
| D629,712 | S | 12/2010 | Humphries | |
| D631,780 | S | 2/2011 | Levy | |
| D635,885 | S | 4/2011 | Humphries | |
| 7,918,108 | B1 | 4/2011 | Lynch et al. | |
| 7,950,117 | B2 * | 5/2011 | Elhaj | 27/1 |
| 7,980,095 | B1 | 7/2011 | Masterson | |
| 8,015,673 | B2 | 9/2011 | Rodman | |
| 8,113,013 | B2 | 2/2012 | Kessler | |
| 8,209,824 | B2 | 7/2012 | Fuhtman | |
| 8,261,416 | B2 | 9/2012 | Rothbaum et al. | |
| 2012/0044031 | A1 * | 2/2012 | Ninomiya | H01F 7/0263 335/219 |
| 2016/0037868 | A1 * | 2/2016 | Lambert | A45C 13/1069 24/303 |

* cited by examiner

SYSTEMS AND APPARATUS OF MAGNETIC CLASPING

TECHNICAL FIELD

The present disclosure is generally related to clasping and, more particularly, is related to magnetic clasping.

BACKGROUND

Connecting two ends of an article together has been solved in many ways. These ways include conventional magnetic clasps, toggle clasps, spring ring clasps, barrel clasps, lobster clasps, s-hook clasps, pearl clasps, and box clasps, among others. Some incorporate locks to ensure the security of the clasps. Conventional magnetic clasps rely solely on the magnetic attraction of the magnetic inserts and may become disconnected from each other when subjected to loads exceeding the magnetic attraction of the magnetic inserts. Clasps such as the spring ring and lobster clasps require a manual movement of a lever to open and/or close the clasps. Toggle clasps incorporate a bar and another piece, usually round, that the bar is inserted through to secure the connection. There are heretofore unaddressed needs with previous solutions, including insufficient security, difficulty in securing and/or removing, and unaesthetic addition to the article.

SUMMARY

Example embodiments of the present disclosure provide systems of magnetic clasping. Briefly described, in architecture, one example embodiment of the system, among others, can be implemented as follows: a clasp, comprising: at least one magnet; a keyway in a mating surface of the clasp; and a key in the mating surface, the key matched to the keyway.

Embodiments of the present disclosure can also be viewed as providing methods for magnetic clasping. In this regard, one embodiment of such a method, among others, can be broadly summarized by the following steps: providing a pair of clasps, each clasp comprising: at least one magnet; a keyway in a mating surface of the clasp; and a key in the mating surface, the key matched to the keyway; and connecting the mating surface of a first clasp of the pair of clasps with the mating surface of a second clasp of the pair of clasps.

DETAILED DESCRIPTION

Figure 1:
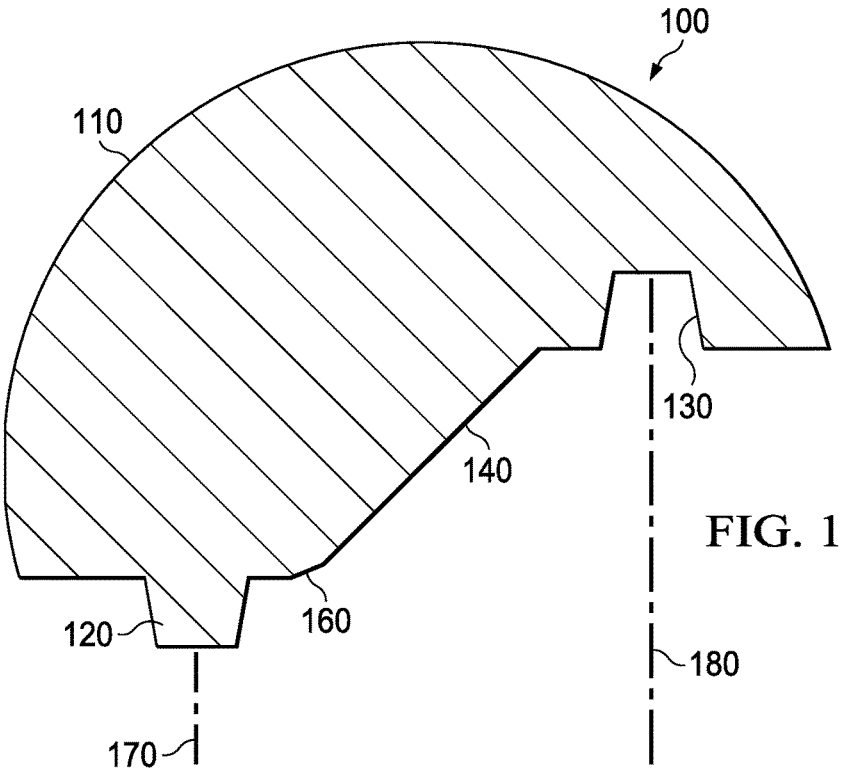
FIG. 1 is a cross-sectional view of an example embodiment of a system of magnetic clasping.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Conventional clasps tend to be difficult for most people to connect and disconnect. Conventional magnetic claps allow ease in connection but are often not secure enough and will come apart. Other clasps lock but are more complex and, so, are difficult to connect and disconnect. In example embodiments of the systems and methods of magnetic clasping disclosed herein, the clasps are self-aligning and can be secured together using one hand. Also, one hand may be used to slide the clasps for release. An example embodiment of the clasps comprise a pair of magnets that secure the clasps together against a forty-five degree angle sliding face. The magnets pull the parts together. While the magnets are pulling the parts together, the key of a first clasp fits into the keyway of a second clasp and the key of the second clasp fits in the keyway of the first clasp. In an example embodiment, the clasps are identical. In an example embodiment, the key and keyway centerlines are perpendicular to a connection hole through the center line of the geometric shape of the clasps, such as a sphere. A connection port, where a linking member connects to the clasp, is perpendicular to the key(s) and keyway(s). The wire may be brought in through the hole and brought around/through a bead or through geometry within the clasp, back out through the hole, and crimped. An example embodiment comprises one hole, but alternative embodiments could include multiple holes. An example embodiment comprises a single key and a keyway in each clasp, but there could be multiple keys and keyways. There could be two keys and two keyways or three keys and three keyways, and still have the same functionality. In an example embodiment, the connection of the wire to the clasp is perpendicular to the center line of the key.

Example embodiments of the systems and methods of magnetic clasping disclosed herein include a a self-aligning interlocking magnetic clasp. When the two halves are placed within close proximity of each other, the magnetic attraction of the magnets within the clasps orient the parts, and the mechanical features of a key, a keyway and a sliding face align. These features hold the two clasps together with the opposed sliding faces coincident and the keys and keyways interlocked, forming a bead shape, for example, with a hole through the middle.

The magnets keep the halves together and the keys and keyways have four faces between the two components that interlock. The perpendicular orientation of the hole to the vertical faces of the key and keyways resist direct forces and tangential or twisting forces applied to the clasp along this axis. This mechanical configuration produces an interlocking, self-aligning magnetic clasp that can resist forces that are multiple times stronger than the magnetic attraction alone.

The disclosed magnetic clasp offer several benefits. The clasp may be plated, painted, et.al to match the other jewelry components that it is combined with, making the clasp virtually invisible. Alternatively, the clasp may be adorned with decoration that would make it the focal point on the jewelry item too. The ability to provide a clasp that resists larger forces in a smaller package permits the clasp to be utilized in numerous applications not typically possible with existing magnetic bead clasps on the market today. The clasp can be installed and removed using one hand. The clasp design may be incorporated into other geometric shapes, e.g. capsule, cylinder, rectangle, etc. Conventional magnetic clasps rely solely on the magnetic attraction of the magnetic inserts and may become disconnected from each other when subjected to loads exceeding the magnetic attraction of the magnetic inserts.

It is an objective of the systems and methods of magnetic clasping disclose herein to overcome the above-mentioned disadvantage of conventional magnetic clasps. An example embodiment of the systems and methods of magnetic clasping disclosed herein is a magnetically attractable self-aligning interlocking jewelry clasp comprising two halves such that when the two halves are placed within close proximity of each other, the magnetic attraction of the magnetic inserts within the clasps orient the components and the mechanical features of key, keyway and sliding face align and secure the two halves together with the opposed sliding faces coincident and the keys and keyways interlocked. The resulting assembled arrangement produces secure clasp with an opening perpendicular to the mechanical features and through the midline of the geometric shape.

In an example embodiment, the magnetic inserts are assembled within the clasp to correctly orient the clasps during connection. The positive and negative axis of the magnetic inserts may be reversed between the pockets of each half. This orientation of the magnetic inserts assists with proper alignment during connection to produce the desired geometric shape. In addition, the magnetic repulsion created from this assembled geometry assists with the removal of the jewelry clasp. As a result of the interlocking attachment provided by the mechanical means of the clasp, the clasp may be slid apart along the plane parallel to the key and keyway and against the sliding face to remove the jewelry item. As the magnetic insert approaches the opposing magnetic insert in the adjacent clasp, the opposing magnetic forces repulse the adjacent clasp and disengage the clasps from one another. This magnetic repulsion minimizes the distance required to slide the halves during disassembly.

FIG. 1 provides a cross-sectional view of an example embodiment of clasp 100 with outer surface 110, key 120, keyway 130, mating surface 140, and chamfer 160. In an example embodiment, key 120 and keyway 130 are configured to be mateable. Chamfer 160 is optional and allows for easier mating of clasp 100 with a substantially identical clasp. Centerline 170 of key 120 and centerline 180 of keyway 130 may be configured to be substantially parallel. Mating surface 140 is configured at a forty-five degree angle between the parallel midpoint planes. Mating surface 140 may be substantially flat or any non-flat surface that mates with the surface of an opposite clasp.

Figure 2:
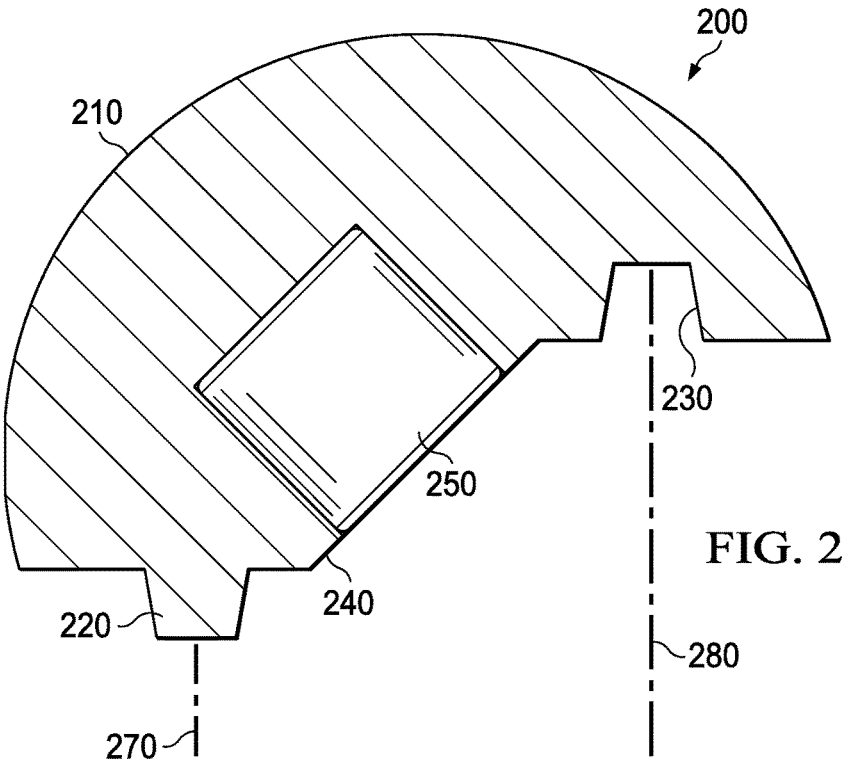
FIG. 2 is a cross-sectional view of an example embodiment of a system of magnetic clasping.

FIG. 2 provides a cross-sectional view of an example embodiment of clasp 200 with outer surface 210, mating surface 240, key 220, keyway 230, and magnet 250. In an example embodiment, key 120 and keyway 130 are configured to be mateable. Midpoint plane 270 of key 220 and midpoint plane 280 of keyway 230 may be configured to be substantially parallel. Mating surface 240 may be configured at a forty-five degree angle between the parallel midpoint planes. Magnet 250 may be configured to be flush with mating surface 240. In an example embodiment, clasp 200 comprises two magnets, a first magnet and a second magnet, both flush with mating surface 240 and both at 45 degree angles with midpoint planes 270 and 280. In an alternative embodiment, in which clasp 200 and its mating clasp are not identical, the angle and configuration of mating surface 240 may be something other than flat/or 45 degrees. The first magnet has a first polarity (such as North) at mating surface 240 and the second magnet has a second polarity, opposite from the first polarity (such as South) at mating surface 240. The magnets may, alternatively, not be flush with mating surface 240, but, instead, be housed internally in clasp 200.

Figure 3:
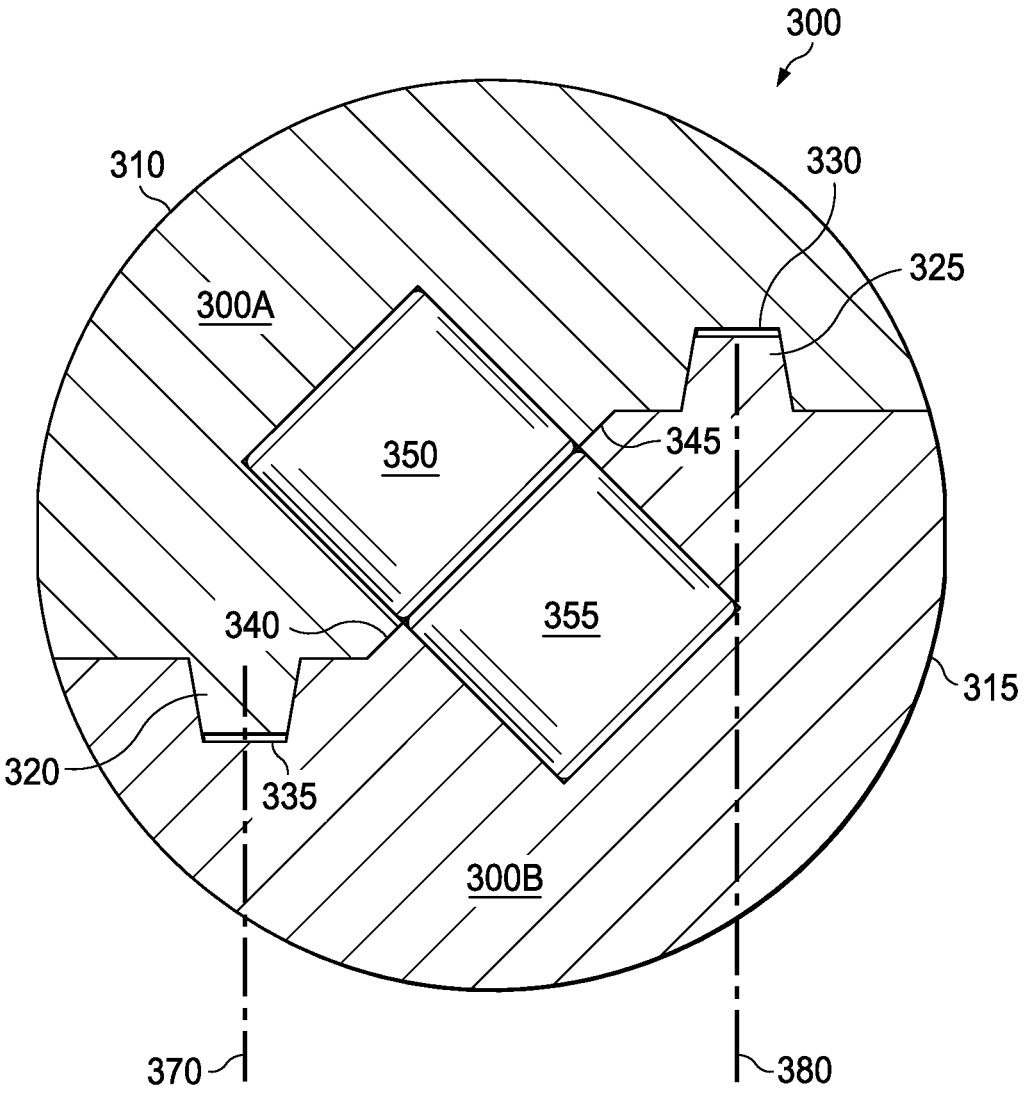
FIG. 3 is a cross-sectional view of an example embodiment of a system of magnetic clasping.

FIG. 3 provides a cross-sectional view of an example embodiment of clasping system 300 with first clasp 300A and second clasp 300B. First clasp 300A may comprise outer surface 310, mating surface 340, key 320, keyway 330, and magnet 350. Second clasp 300B may comprise outer surface 315, mating surface 345, key 325, keyway 335, and magnet 355. In an example embodiment, key 320 and keyway 335 are configured to mate and key 325 and keyway 330 are configured to mate. Midpoint plane 370 of key 320 and keyway 335 and midpoint plane 380 of key 325 and keyway 330 may be configured to be substantially parallel. Mating surfaces 340 and 345 may be configured at a forty-five degree angle between the parallel midpoint planes. Magnets 350 and 355 may be configured to be flush with mating surfaces 340 and 345. Mating surfaces 340 and 345 are configured to mate against each other.

In an example embodiment, clasps 300A and 300B each comprise two magnets, a first magnet and a second magnet, both flush with mating surfaces 340, 345 and both at 45 degree angles with the midpoint planes 370 and 380. The first magnet of clasp 300A has a first polarity (such as North) at mating surface 340 and the second magnet has a second polarity, opposite from the first polarity (such as South) at mating surface 340. The first magnet of clasp 300B has a first polarity (such as North) at mating surface 345 and the second magnet has a second polarity, opposite from the first polarity (such as South) at mating surface 345. When clasp 300A is mated with clasp 300B the first magnet (with the first polarity) of clasp 300A mates with the second magnet (with the second, opposite polarity) of clasp 300B and the second magnet of clasp 300A (with the second, opposite polarity) mates with the first magnet of clasp 300B (with the first polarity). The magnetic forces of magnets 350 and 355 attract clasps 300A and 300B together, and the mating of keys 320 and 325 into keyways 335 and 330, respectively, secure the clasps from pulling apart. To pull clasps 300A and 300B apart, the clasps are moved laterally along the key/keyway until the magnets are no longer attracting and they clasps are easily pulled apart.

Figure 4:
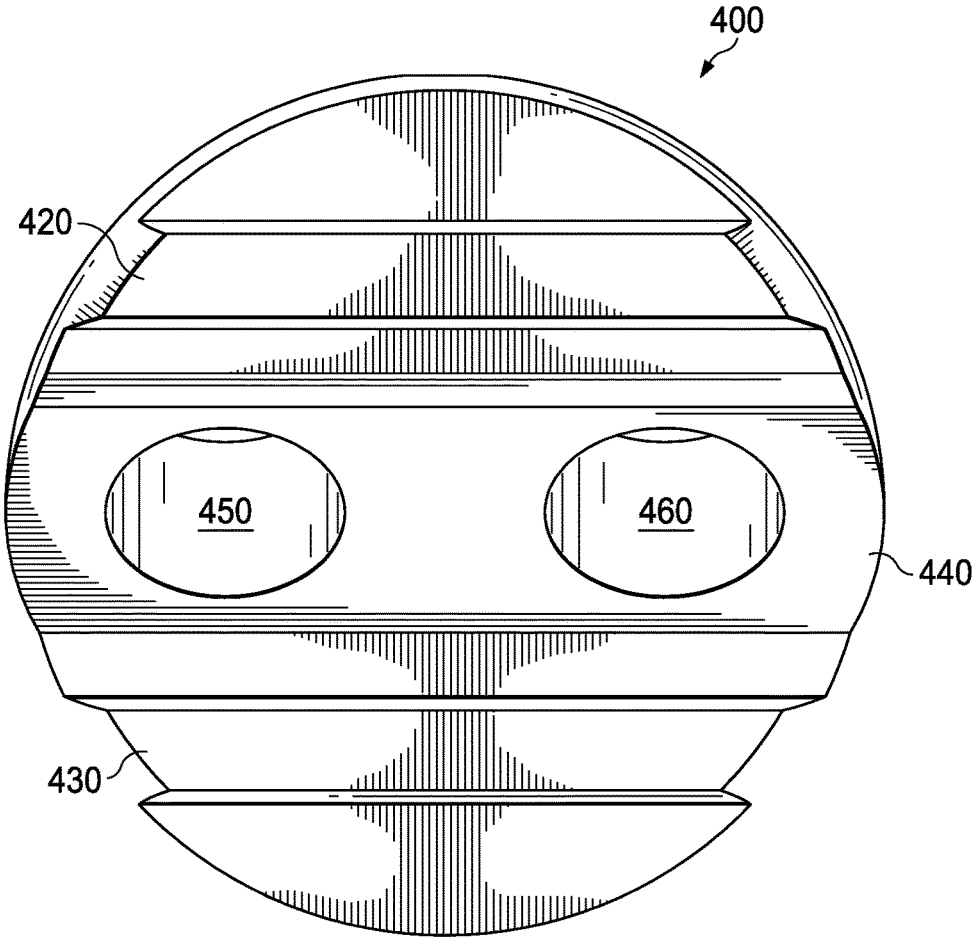
FIG. 4 is a perspective view of an example embodiment of a system of magnetic clasping.

FIG. 4 provides a perspective view of an example embodiment of clasp 400. Clasp 400 comprises key 420, keyway 430, mating surface 440, first magnet 450 and second magnet 460. In an example embodiment, key 420 and keyway 430 are configured to be mateable. A first midpoint plane of key 420 and a second midpoint plane of keyway 430 may be configured to be substantially parallel. Mating surface 440 may be configured at a forty-five degree angle between the parallel midpoint planes. Magnets 450 and 460 may be configured to be flush with mating surface 440. Magnet 450 may be configured to have a first polarity (such as North) at mating surface 440 and magnet 460 may be configured to have a second polarity, opposite from the first polarity (such as South) at mating surface 440. In an alternative embodiment, each clasp may have a North/North pair or a South/South pair of magnets.

Figure 5:
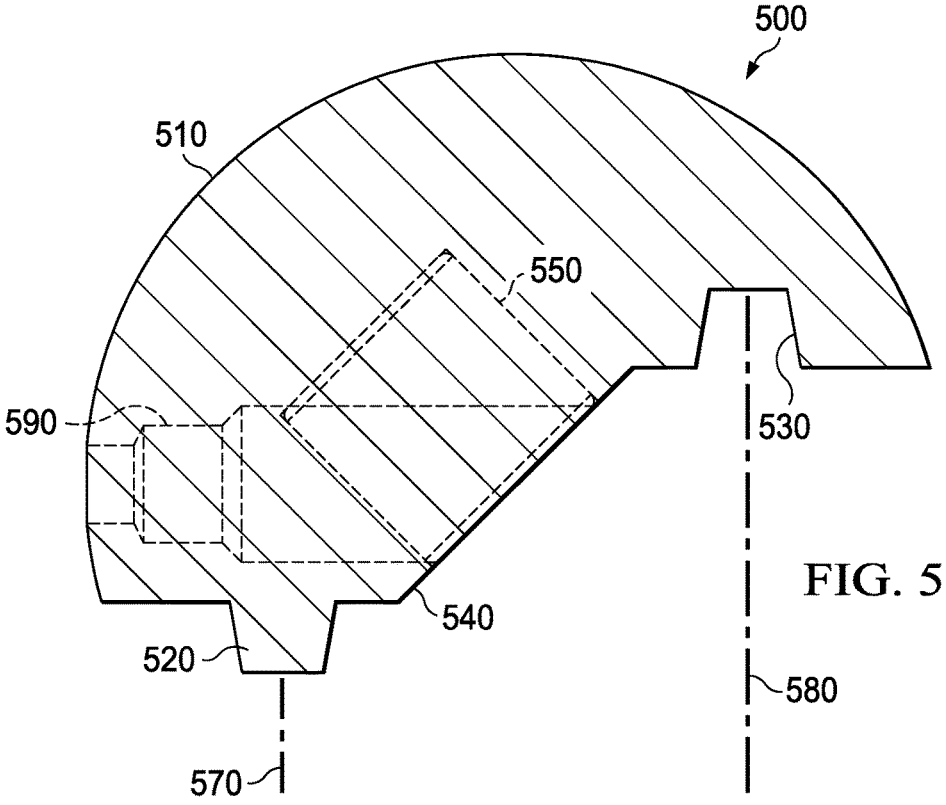
FIG. 5 is a cross-sectional view of an example embodiment of a system of magnetic clasping.

FIG. 5 provides a cross-sectional view of an example embodiment of clasp 500 with outer surface 510, mating surface 540, key 520, keyway 530, magnet 550, and connection port 590. In an example embodiment, key 520 and keyway 530 are configured to be mateable. Midpoint plane 570 of key 520 and midpoint plane 580 of keyway 530 may be configured to be substantially parallel. Mating surface 540 may be configured at a forty-five degree angle between the parallel midpoint planes. Magnet 550 may be configured to be flush with mating surface 540. In an example embodiment, clasp 500 comprises two magnets, a first magnet and a second magnet, both flush with mating surface 540 and both at 45 degree angles with midpoint planes 570 and 580. The first magnet has a first polarity (such as North) at mating surface 540 and the second magnet has a second polarity, opposite from the first polarity (such as South) at mating surface 540.

In an example embodiment, connection port 590 extends through clasp 500, from outer surface 510 to mating surface 540 and between the first magnet and the second magnet. Connection port 590 may be configured to be ninety degrees from parallel midpoint planes 570 and 580. In an example embodiment, connection port 590 is graduated from smaller near outer surface 510 to larger at mating surface 540. In an example embodiment of connecting the clasp to the end of a necklace, as a non-limiting example, the end of the necklace string may be passed through the outer surface end of connection port 590 and out of the mating surface end of connection port 590, around a looper means (for example through a bead or around a grooved loop) and back through connection port 590 from mating surface 540 to outer surface 510, where it may be crimped using various means. The looper means may be configured to be small enough to fit in connection port 590 on the mating surface end, but not fit through connection port 590 on the outer surface end.

In an alternative embodiment, instead of using connection port 590, the connection of the necklace end, for example, may be connected directly to outer surface 510 (for example, by soldering), or tied to a connector which is, for example, soldered directly to outer surface 510. Although the connection may be made to clasp 500 at any point on outer surface 510, it is preferable that the tension from the connection be at ninety degrees from parallel midpoint planes 570 and 580. Alternatively, the necklace may be manufactured with outer surface 510.

Figure 6:
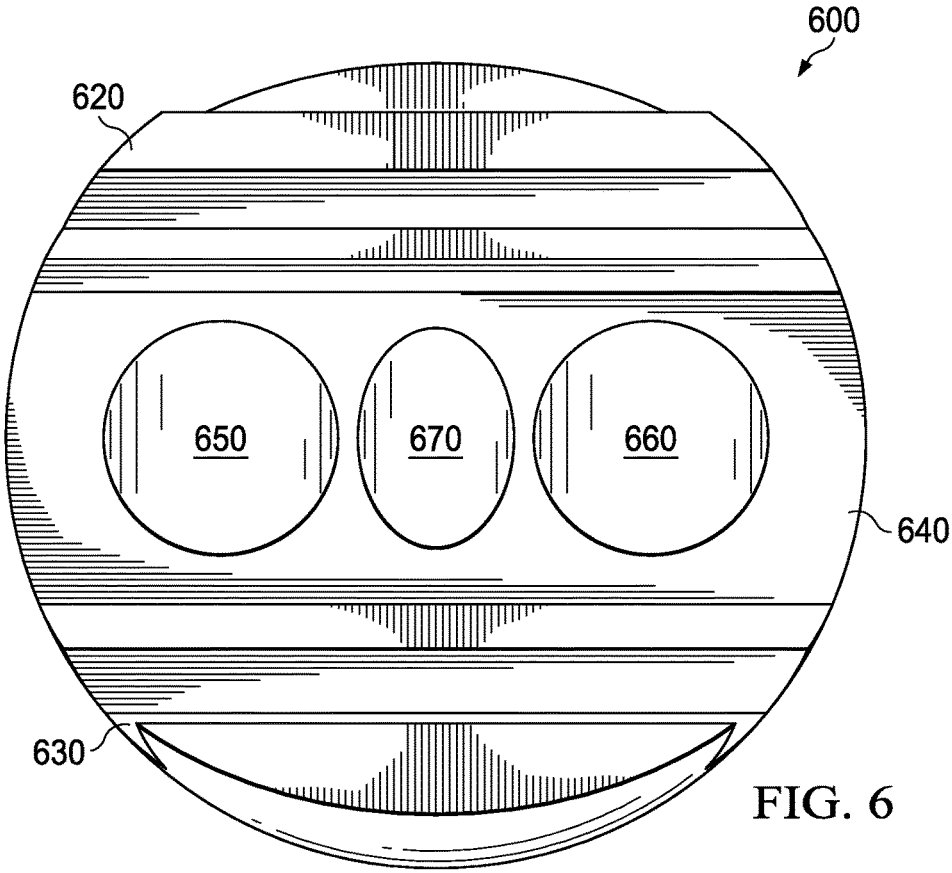
FIG. 6 is a perspective view of an example embodiment of a system of magnetic clasping.

FIG. 6 provides a perspective view of an example embodiment of clasp 600. Clasp 600 comprises key 620, keyway 630, mating surface 640, first magnet 650, second magnet 660, and connection port 670. In an example embodiment, key 620 and keyway 630 are configured to be mateable. A first midpoint plane of key 620 and a second midpoint plane of keyway 630 may be configured to be substantially parallel. Mating surface 640 may be configured at a forty-five degree angle between the parallel midpoint planes. Magnets 650 and 660 may be configured to be flush with mating surface 640. Magnet 650 may be configured to have a first polarity (such as North) at mating surface 640 and the magnet 660 may be configured to have a second polarity, opposite from the first polarity (such as South) at mating surface 640.

In an example embodiment, connection port 670 extends through clasp 600, from the outer surface to mating surface 640 and between magnet 650 and magnet 660. Connection port 670 may be configured to be ninety degrees from the parallel midpoint planes. In an example embodiment, connection port 670 is graduated from smaller near the outer surface of clasp 600 to larger at mating surface 640. In an example embodiment of connecting the clasp to the end of a necklace, as a non-limiting example, the end of the necklace string may be passed through the outer surface end of connection port 670 and out of the mating surface end of connection port 640, around a looper means (for example through a bead or around a grooved loop) and back through connection port 670 from mating surface 640 to the outer surface of clasp 600, where it may be crimped using various means. The looper means may be configured to be small enough to fit in connection port 670 on the mating surface end, but not fit through connection port 670 on the outer surface end. In an alternative embodiment, connection port 670 may comprise parallel holes to create a looping means within clasp 600.

Figure 7:
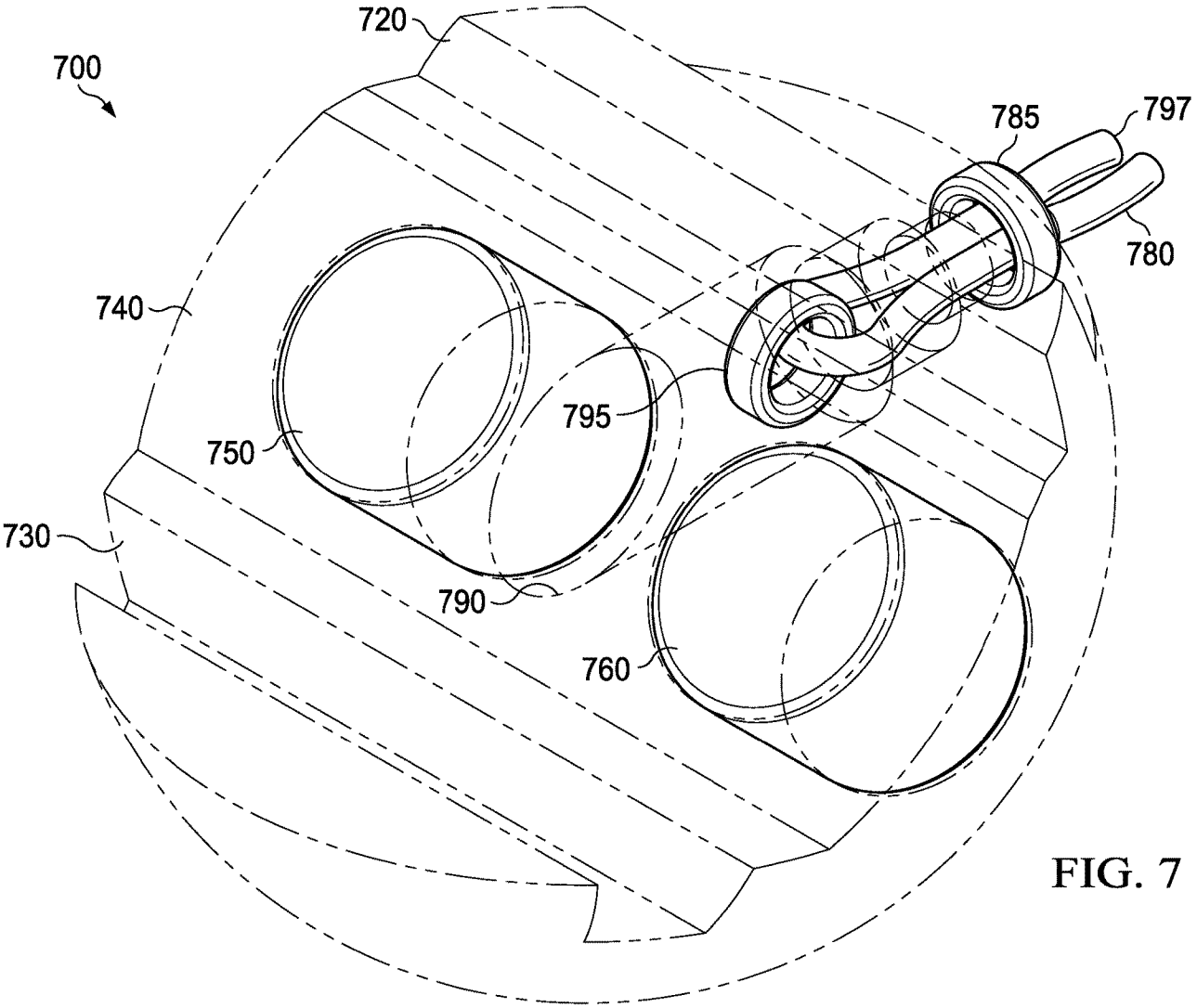
FIG. 7 is a perspective view of an example embodiment of a system of magnetic clasping.

FIG. 7 provides a perspective view of an example embodiment of clap 700 including key 720, keyway 730, first magnet 750, second magnet 760, connection port 790, first end of string 780, looper means 795, crimping means 785, and second end of string 797. In an example embodiment, key 720 and keyway 730 are configured to be mateable. A first midpoint plane of key 720 and a second midpoint plane of keyway 730 may be configured to be substantially parallel. Mating surface 740 may be configured at a forty-five degree angle between the parallel midpoint planes. Magnets 750 and 760 may be configured to be flush with mating surface 740. Magnet 750 may be configured to have a first polarity (such as North) at mating surface 740 and the magnet 760 may be configured to have a second polarity, opposite from the first polarity (such as South) at mating surface 740.

In an example embodiment, connection port 790 extends through clasp 700, from the outer surface to mating surface 740 and between first magnet 750 and second magnet 760. Connection port 790 may be configured to be ninety degrees from the parallel midpoint planes. In an example embodiment, connection port 790 is graduated from smaller near the outer surface of clasp 700 to larger at mating surface 740. In an example embodiment of connecting clasp 700 to the end of a necklace, as a non-limiting example, end 780 of necklace string 797 may be passed through the outer surface end of connection port 790 and out of the mating surface end of connection port 790, around looper means 795 (for example through a bead or around a grooved loop) and back through connection port 790 from mating surface 740 to the outer surface of clasp 700, where it may be crimped using crimping means 785. Looper means 795 may be configured to be small enough to fit in connection port 790 on the mating surface end, but not fit through connection port 790 on the outer surface end.

Figure 8:
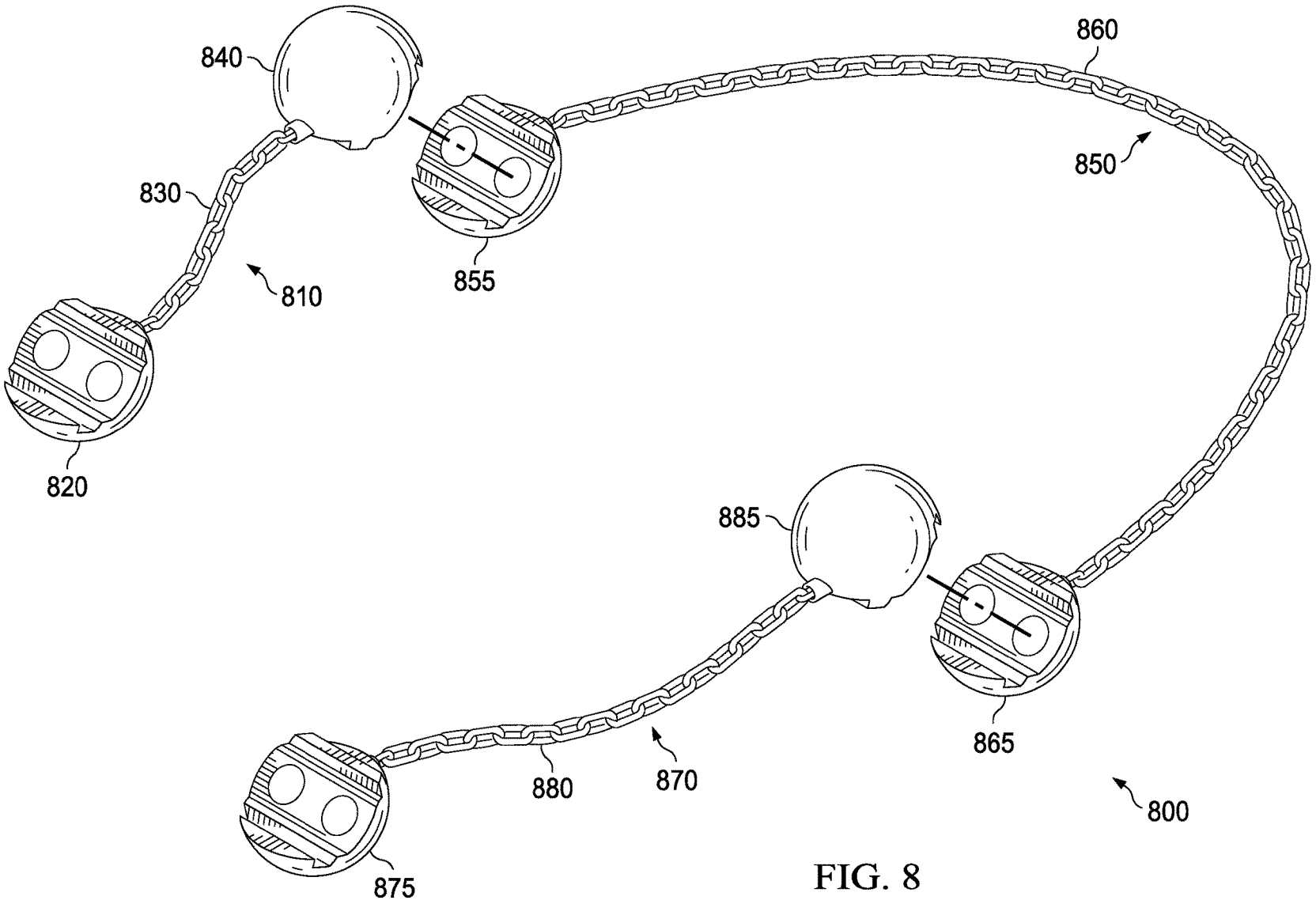
FIG. 8 is a perspective view of an example embodiment of a system of magnetic clasping.

FIG. 8 provides a perspective view of an example embodiment of clasping system 800 including first section 810, second section 850, and third section 870. First section 810 comprises first clasp 820, first linking member 830 and second clasp 840. Second section 850 comprises third clasp 855, second linking member 860, and fourth clasp 865. Third section 870 comprises fifth clasp 875, third linking member 880 and sixth clasp 885. Each clasp may be connected to any other clasp, as all clasps are substantially identical. For example, first clasp 820 may be connected to fifth clasp 875, sixth clasp 885 may be connected to fourth clasp 865, and third clasp 855 may be connected to second clasp 840. Although only three sections are provided, clasping system 800 may have any number of sections from a single section with two clasps, and making it as long as desired. Linking members 830, 850, and 880 may be comprised of any of a number of materials, including, but not limited to metal, nylon, crystal, glass, metallic and nonmetallic materials, leather, string, and other natural, man-made and synthetic materials.

Figure 9:
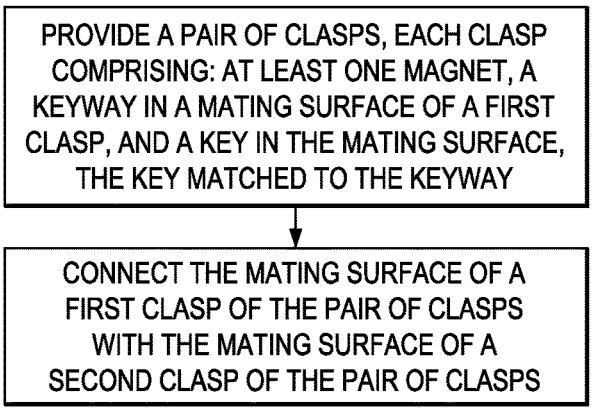
FIG. 9 is a flow diagram of an example embodiment of a method of magnetic clasping.

FIG. 9 provides flowchart 900 of a method of magnetic clasping. In block 910, a pair of clasps is provided, each clasp comprising: at least one magnet; a keyway in a mating surface of the clasp; and a key in the mating surface, the key matched to the keyway. In block 920 the mating surface of a first clasp of the pair of clasps is connected with the mating surface of a second clasp of the pair of clasps Although example embodiments of the clasps have been shown through jewelry implementations, the clasps have many other uses such as a detachable lure for a fishing line, connecting ropes between posts, backpacks, et cetera. Although shown as a sphere, a pair of clasps may take any shape, such as a cube, a pyramid, capsule, cylinder, or any other shape or figure.

Although the present invention has been described in detail, it should be understood that various changes, substitutions and alterations can be made thereto without departing from the spirit and scope of the invention as defined by the appended claims.

Therefore, at least the following is claimed:

1. A connection system comprising:

a clasp, comprising:

a first magnet with a first polarity at a mating surface of the clasp;

a second magnet with a second opposite polarity at the mating surface of the clasp;

a keyway in the mating surface of the clasp, the keyway extending across the mating surface from one side to the other; and a key in the mating surface, the key matched to the keyway, wherein the first and second magnets are located between the key and the keyway, wherein the key and keyway control a direction of separation of the clasp along a line parallel to a line that passes through a center of both the first and second magnets.

2. The connection system of claim 1, further comprising a second clasp to form a mated pair, each clasp of the mated pair of clasps being substantially identical.

3. The connection system of claim 1, wherein a key midpoint plane and a keyway midpoint plane are parallel planes.

4. The connection system of claim 3, wherein the mating surface is configured at a forty-five-degree angle between the parallel midpoint planes.

5. The connection system of claim 3, further comprising a connection means, the connection means configured to be perpendicular to the parallel midpoint planes.

6. The connection system of claim 5, wherein the connection means comprises a connection port, a stringing means, a looper means, and a crimping means.

7. The connection system of claim 1, wherein at least one end of the mating surface is chamfered.

8. The connection system of claim 1, wherein at least one side of the key is not parallel to the opposing side of the key.

9. A method of connecting, comprising:

providing a pair of clasps, each clasp comprising:

a first magnet with a first polarity at a mating surface of the clasp;

a second magnet with a second opposite polarity at the mating surface of the clasp;

a keyway in the mating surface of the clasp, the keyway extending across the mating surface from one side to the other; and a key in the mating surface, the key matched to the keyway, wherein the first and second magnets are located between the key and the keyway, wherein the key and keyway control a direction of separation of the clasp along a line parallel to a line that passes through a center of both the first and second magnets; and connecting the mating surface of a first clasp of the pair of clasps with the mating surface of a second clasp of the pair of clasps.

10. The method of claim 9, wherein each clasp of the pair of clasps is substantially identical.

11. The method of claim 9, wherein a key midpoint plane and a keyway midpoint plane are parallel planes.

12. The method of claim 11, wherein the mating surface is configured at a forty-five-degree angle between the parallel midpoint planes.

13. A connection system, comprising:

at least one pair of clasps, each clasp of the pair of clasps comprising:

a keyway in a mating surface of the clasp, the keyway extending across the mating surface from one side to the other;

a key in the mating surface, the key matched to the keyway;

a first magnet with a first polarity at the mating surface; and a second magnet with a second opposite polarity at the mating surface, wherein the first and second magnets are located between the key and the keyway, wherein the key and keyway control a direction of separation of the clasp along a line parallel to a line that passes through a center of both the first and second magnets; and a connection means connected to or through an outer surface of each clasp of the pair of clasps, the outer surface of the clasp different from the mating surface, the clasps configured to connect in a self-aligning manner.

14. The connection system of claim 13, wherein each clasp of the pair of clasps is substantially identical.

15. The connection system of claim 13, wherein matings of the key and key way of each clasp of the pair of clasps controls the motion of the sliding perpendicular to the magnetic field of the first and second magnets.

16. The connection system of claim 13, wherein a key midpoint plane and a keyway midpoint plane are parallel planes and the mating surface is configured at a forty-five-degree angle between the parallel midpoint planes.

17. The connection system of claim 13, wherein the connection means connects to an outer surface of the clasp, the connection means being perpendicular to parallel midpoint planes of the key and the keyway.

18. The connection system of claim 17, wherein the connection means comprises a connection port, a stringing means, a looper means, and a crimping means.

* * * * *